US005329264A

United States Patent [19]

Toda et al.

[11] Patent Number: 5,329,264

[45] Date of Patent: Jul. 12, 1994

[54] CIRCUIT BREAKER WITH OVERCURRENT TRIPPING DEVICE

[75] Inventors: Haruhisa Toda; Takafumi Kondo, both of Fukuyama, Japan

[73] Assignee: Mitsubishi Denki Kabushiki Kaisha, Tokyo, Japan

[21] Appl. No.: 43,469

[22] Filed: Mar. 25, 1993

[30] Foreign Application Priority Data

Jun. 4, 1992 [JP] Japan ..... 4-144227

[51] Int. Cl.[5] ..... H01H 75/12

[52] U.S. Cl. ..... 335/35; 335/42

[58] Field of Search ..... 335/23-25, 335/167-176, 35-43

[56] References Cited

U.S. PATENT DOCUMENTS

| | | | |
|---|---|---|---|
| 2,902,560 | 9/1959 | Stanback et al. . | |
| 3,264,435 | 8/1966 | Klein et al. | 335/35 |
| 3,305,653 | 2/1967 | Strobel . | |
| 3,317,867 | 5/1967 | Powell . | |
| 3,936,780 | 2/1976 | Hennemann | 335/38 |
| 4,074,218 | 2/1978 | Salvati et al. . | |
| 4,503,408 | 3/1985 | Mrenna et al. . | |
| 4,691,182 | 9/1987 | Mrenna et al. . | |

FOREIGN PATENT DOCUMENTS

| | | |
|---|---|---|
| 0111140 | 6/1984 | European Pat. Off. . |
| 1588507 | 6/1971 | Fed. Rep. of Germany . |
| 1763193 | 9/1972 | Fed. Rep. of Germany . |
| 3-19236 | 2/1991 | Japan . |

*Primary Examiner*—Lincoln Donovan

*Attorney, Agent, or Firm*—Burns, Doane, Swecker & Mathis

[57] ABSTRACT

An overcurrent tripping device which is included in a circuit breaker is constituted by a pre-assembly unit of a holder with a conductor, a fixed core for generating a magnetic attraction force responding to an overcurrent, and a bimetal warping responding to the temperature rise of the conductor, and an operation arm rotatably borne on the holder and having a moving core which is to be attracted to the fixed core by the magnetic attraction force.

4 Claims, 4 Drawing Sheets

CIRCUIT BREAKER WITH OVERCURRENT TRIPPING DEVICE

BACKGROUND OF THE INVENTION

1. Field of the Invention

The present invention relates to a circuit breaker with an overcurrent tripping device which operates a time limit tripping by a bimetal and an instantaneous tripping by an electromagnet.

2. Description of the Prior Art

A conventional circuit breaker with an overcurrent tripping device, which is, for example, shown in a Gazette of Unexamined Japanese Utility Model Application Hei 3-19236, is described referring to FIG. 4. FIG. 4 is a sectional side view schematically showing a constitution of the conventional circuit breaker, and especially showing the conventional overcurrent tripping device of the circuit breaker.

As shown in FIG. 4, the conventional circuit breaker comprises a housing 1 made of a resin. The housing 1 consists of a base member 1*a* and a cover member 1*b*. A conductor 2, whereon a load current flows, is fixed on the base member 1. An end 2*a* of the conductor 2 is connected to a known moving contact mechanism (which is not shown in the figure) and the other end 2*b* is connected to a terminal member 3. A fixed core 4, which has substantially U-letter shaped section in a plane vertical to the paper sheet of FIG. 4, is provided on the conductor 2 for generating a magnetic force by the load current flowing on the conductor 2. A bimetal 5 is fixed to the conductor 2 on an end 5*a* thereof. An adjustable screw 6 is provided on the other free end 5*b* of the bimetal 5 in a manner that an end 6*a* of the screw 6 faces to a trip lever 7. The trip lever 7 is rotatably borne by a pivot 8. An operation arm 9 is rotatably borne by another pivot 11 and has a moving core 10 which is fixed on an end 9*b* and a pushing part 9*a* which is formed on the other end 9*a* for pushing the trip lever 7 when the operation arm 9 rotates in clockwise direction in the figure. An extension spring 12 is provided for supplying a rotation force to the operation arm 9 in a direction to make the moving core 10 separate from the fixed core 4. Another adjustable screw 13 is provided on a fixed part 14 for adjusting a gap between the fixed core 4 and the moving core 10. The above-mentioned pivots 8 and 11 and the fixed part 14 are provided on a frame which is not shown in the figure.

A tripping operation of the above-mentioned conventional circuit breaker with the overcurrent tripping device is described as follows.

When an overload current which is a little larger than a rated current of the conductor 2 flows, the bimetal 5 warps. And thereby, the end 6*a* of the screw 6 contacts the trip lever 7. As a result, the trip lever 7 rotates in clockwise direction in the figure.

When an overload current which is larger than a predetermined value flows on the conductor 2, the fixed core 4 generates a magnetic attraction force, and the moving core 10 is momentarily attracted to the fixed core 4. Thereby, the operation arm 9 rotates in clockwise direction in the figure. When the operation arm 9 rotates, the end 9*a* of the operation lever 9 pushes the trip lever 7. As a result, the trip lever 7 rotates in clockwise direction in FIG. 4.

When the trip lever 7 rotates in clockwise direction in the figure, a latch of a tripping device (which is not shown in the figure) is released. And thereby, the conventional circuit breaker is tripped, and the current is cut off.

In the conventional circuit breaker with overcurrent tripping device configured above, since the fixed core 4 and the moving core 10 are respectively fixed on the independent members such as the base member 1*a* and the frame (not shown in the figure), there are dimensional tolerance limits in the mass-produced parts. Therefore, for making the operation arm 9 to start to rotate by a current of a predetermined value, the gap between the fixed core 4 and the moving core 10 must be adjusted by provision of the adjustable screw 13. Furthermore, since the fixed core 4, the operation arm 9 and so on are respectively held on different independent members, the total size of the overcurrent tripping device becomes larger. And thereby, a larger space is necessary for containing the overcurrent tripping device in the housing 1 of the circuit breaker.

SUMMARY OF THE INVENTION

One purpose of the present invention is to solve the above-mentioned problems and to provide an improved circuit breaker with an overcurrent tripping device wherein any adjustable screw is not necessary for adjusting a gap between a fixed core and a moving core, and the down-sizing of the circuit breaker can be achieved.

A circuit breaker with overcurrent tripping device in accordance with the present invention comprises:

- a conductor, an end thereof being connected to a moving contact mechanism and the other end being connected to a terminal member;
- a fixed core provided in the vicinity of the conductor for generating a magnetic attraction force responding to a current value flowing on the conductor;
- a holder having a bimetal which contacts the conductor and warps responding to a current flowing on the conductor for driving a trip member; and
- an operation arm rotatably borne on the holder and having a moving core on an end thereof in a manner to face to the fixed core, an action part provided on the other end for driving the trip member when the operation arm is rotated in a predetermined direction, and a stopper part for contacting the holder in a manner to keep a predetermined gap between the fixed core and the moving core when the stopper part contacts the holder.

Furthermore, a spring provided between the holder and the operation arm supplies a driving force to the operation arm in a direction to separate the moving core from the fixed core.

In the circuit breaker in accordance with the present invention which is configured above, the holder and the operation arm are previously assembled in a manner that the stopper part of the operation arm contacts the holder for keeping the gaps between the fixed core and the moving core in the predetermined range when the moving core is separated from the fixed core. Therefore, the gap between the fixed core and the moving core in the mass-produced one falls in a given dimensional tolerance.

Furthermore, since the spring is provided between the holder and the operation arm, the rotation force supplied to the operation arm by the spring becomes stable, and the circuit breaker is down-sized.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENTS

Figure 1:
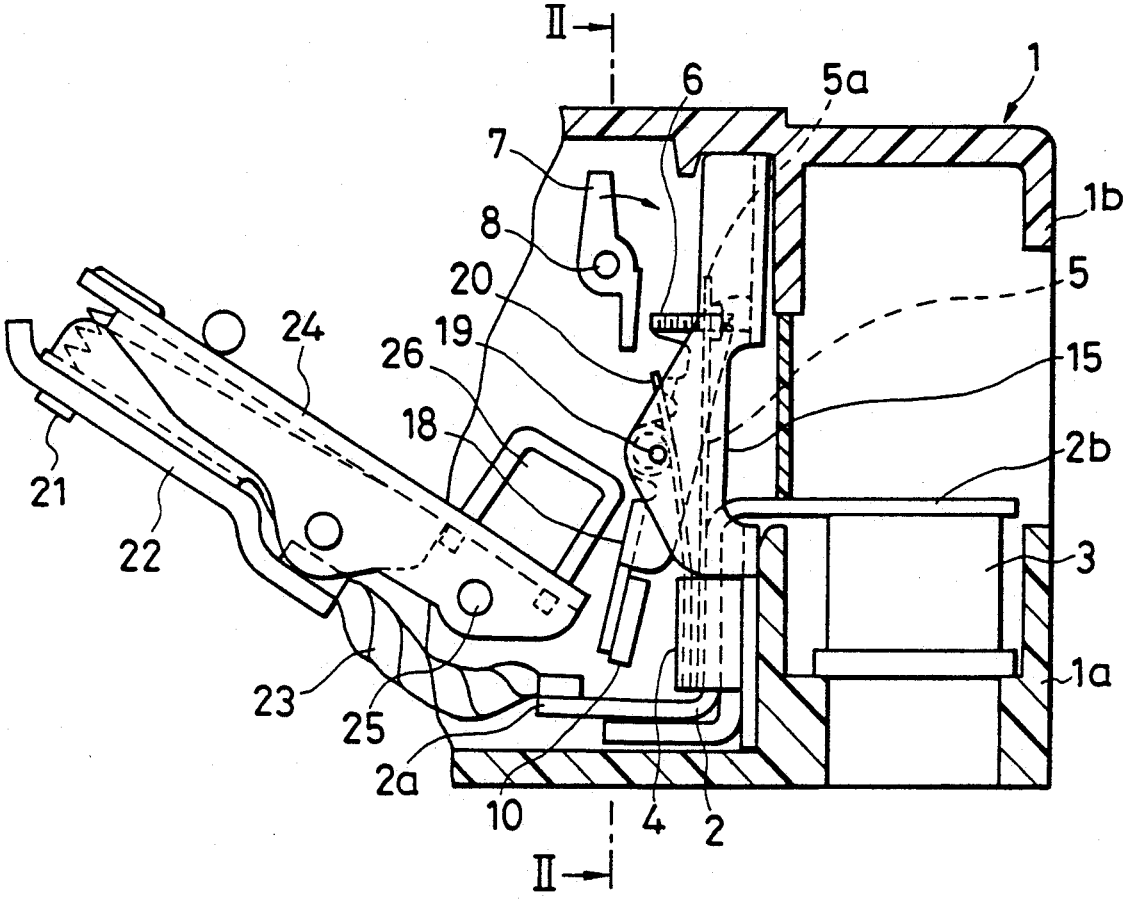
FIG. 1 is a sectional side view showing a constitution of a main part of a circuit breaker with overcurrent tripping device in accordance with the present invention.
Figure 2:
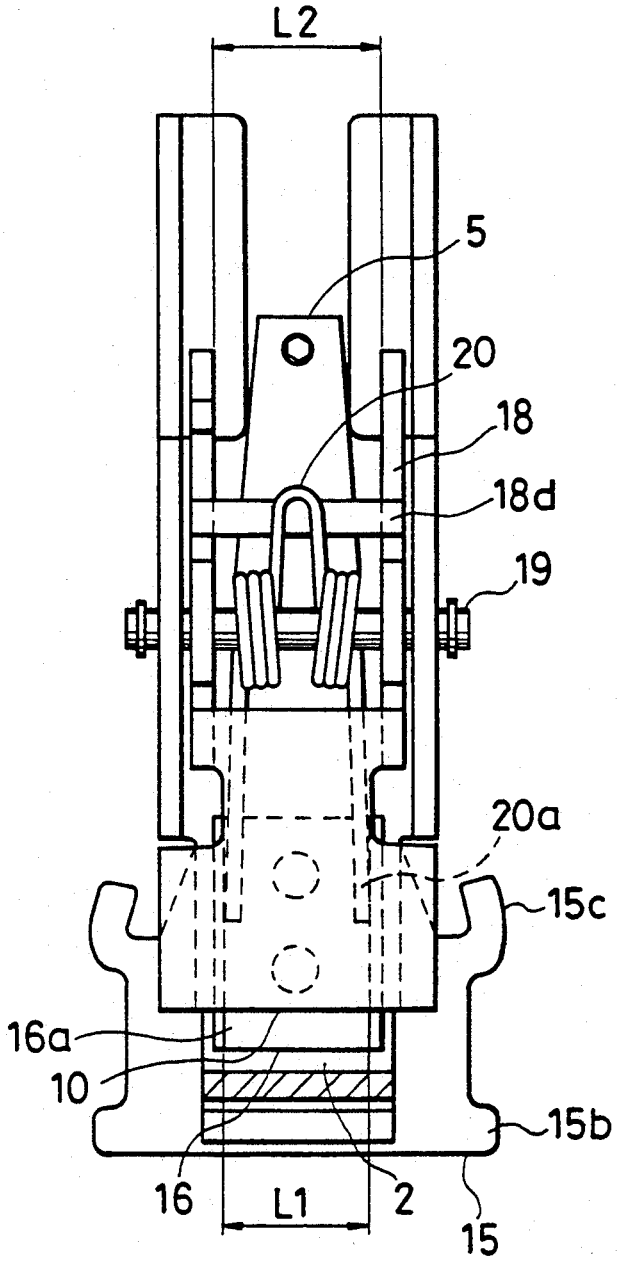
FIG. 2 is a front view showing the constitution of an overcurrent tripping device of the circuit breaker in accordance with the present invention.
Figure 3:
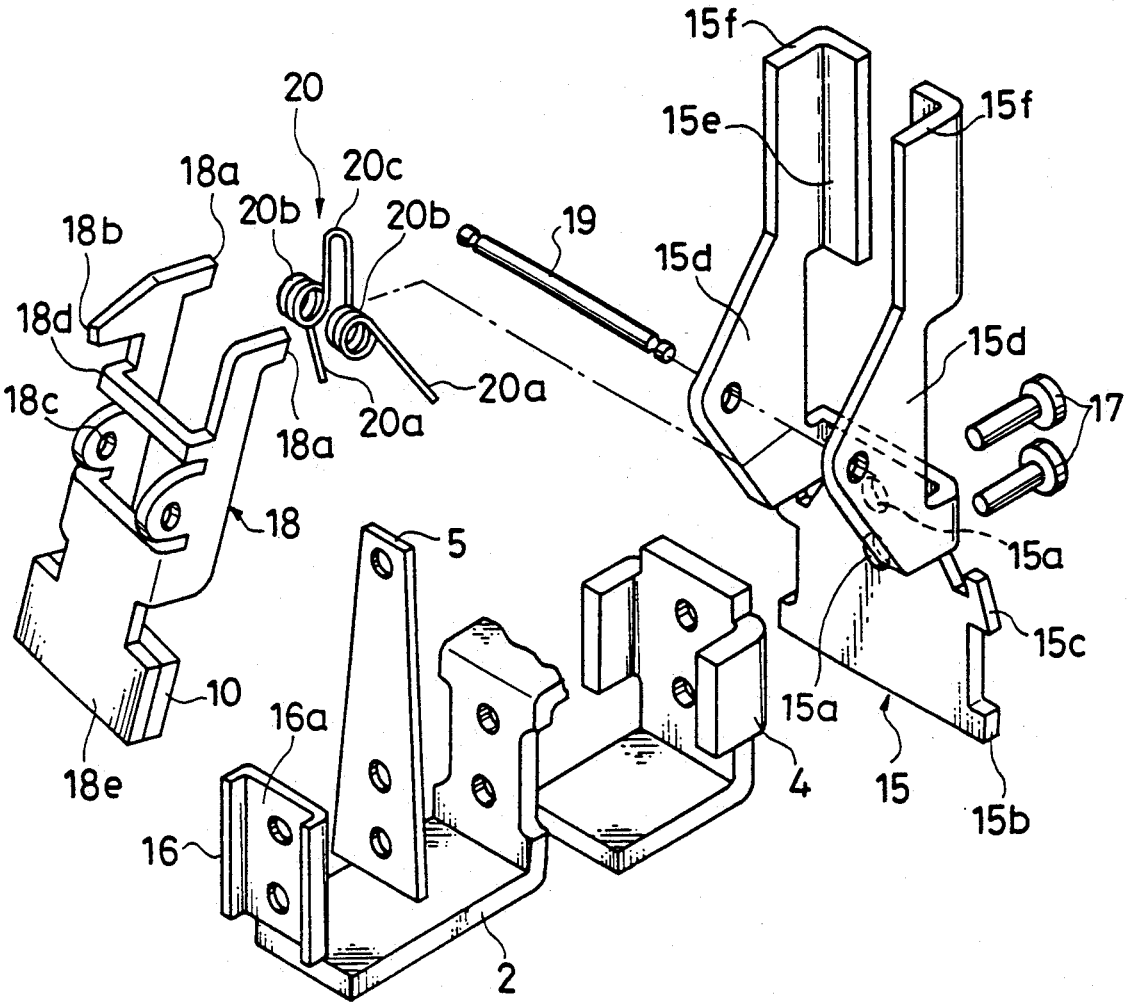
FIG. 3 is an exploded perspective view showing the constitution of the assembly unit shown In FIG. 2.
Figure 4:
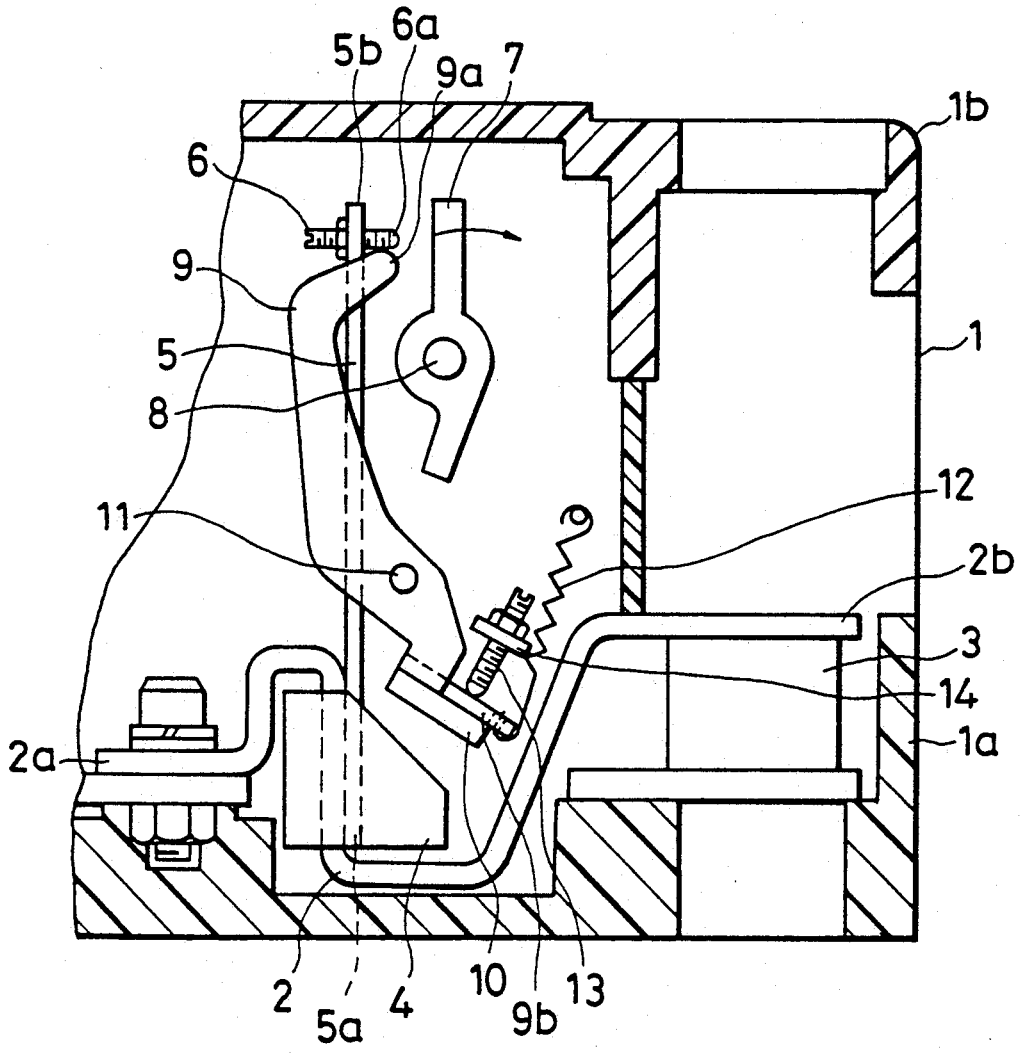
FIG. 4 (Prior Art)
FIG. 4 is the sectional side view showing the constitution of the conventional circuit breaker with overcurrent tripping device.

A preferred embodiment of a circuit breaker with overcurrent tripping device in accordance with the present invention is described referring to FIGS. 1, 2 and 3. FIG. 1 is a sectional side view showing a constitution of a main part of the circuit breaker with an overcurrent tripping device in accordance with the present invention. FIG. 2 is a front view showing the constitution of an overcurrent tripping device of the circuit breaker. FIG. 3 is an exploded perspective View showing the constitution of the assembly unit shown in FIG. 2.

In FIG. 1, a housing 1 of the circuit breaker consists of a base member 1*a* and a cover member 1*b*. An end 2*a* of a conductor 2 is connected to a moving contact mechanism which is described in detail below, and the other end 2*b* of the conductor 2 is connected to a terminal member 3. A fixed core 4, which has substantially U-letter shaped section in a plane vertical to a paper sheet of FIG. 1 and generates a magnetic attraction force responding to a current value flowing on the conductor 2, is provided to be fixed on the conductor 2. A bimetal 5 is provided to be fixed on the conductor 2 at an end 5*b* thereof. An adjustable screw 6 is provided on the other end 5*a* of the bimetal 5. A trip lever 7 is rotatably borne by a pivot 8.

As shown in FIGS. 1, 2 and 3, the conductor 2, the fixed core 4, the bimetal 5 and so on are mounted on a holder 15, and these elements constitute a holder pre-assembly unit. As shown in FIG. 3, the holder pre-assembly unit is formed by piling-up of the order of the holder 15, the fixed core 4, the conductor 2, the bimetal 5 and a presser plate 16 which has a substantially U-letter shaped section. These elements are fixed by caulking of rivets 17 with the presser plate 16. Furthermore, the holder 15 has through-holes 15*a* wherethrough the rivets 17 penetrate and protrusions 15*b* and 15*c* which are to be engaged with grooves formed on the base member 1*a* (not shown in the figure). Bracket parts 15*d* are formed substantially the center of the holder 15 for bearing an operation arm 18. And, stopper parts 15*e* are formed in the vicinity of the top end for regulating the rotation of the operation arm 18. Furthermore, engaging parts 15*f* are formed in the vicinity of the top end which are to be engaged with the cover member 1*b*.

The operation arm 18 is borne so as to be rotatable on the above-mentioned holder pre-assembly unit via a shaft 19. A moving core 10 is fixed on an end 18*e* of the operation arm 18 in a manner to face the fixed core 4. Stopper parts 18*a* which are to contact the stopper parts 15*e* of the holder 15 and a pushing part 18*b* for pushing the trip lever 7 are formed in the vicinity of the other end of the operation arm 18. Furthermore, bearing holes 18*c* wherethrough the shaft 19 penetrates and spring engaging part 18*d* whereby a spring 20 is suspended are formed substantially at the center of the operation arm 18. An operation arm pre-assembly unit consists of the operation arm 18, the moving core 10 and the like.

As shown in FIG. 3, the spring 20 is configured in a double torsion type. Coil parts 20*b* of the spring 20 are penetrated and held by the shaft 19. Center arm part 20*c* of the spring 20 is to be engaged with the spring engaging part 18*d* of the operation arm 18. As shown in FIG. 2, both arms 20*a* of the spring 20 are respectively engaged with the presser plate 16.

As mentioned above, the holder pre-assembly unit, the operation arm pre-assembly unit and the spring 20 are further assembled in one unit, thereby configuring the overcurrent tripping device. As shown in FIG. 1, such an overcurrent tripping device is put between the base member 1*a* and the cover member 1*b*, and thereby, it is contained in the housing 1 of the circuit breaker. Under this condition, the end 2*a* of the conductor 2 is connected to a flexible conductor 23 of the moving contact mechanism. The other end 2*b* of the conductor 2 is connected to the terminal member 3.

As shown in FIG. 1, the moving contact mechanism comprises: a moving contact 21 which is to contact a known stationary contact (not shown in the figure because of being obvious); a moving member 22 which supports the moving contact 21; the flexible conductor 23 which electrically connects the conductor 2 and the moving member 22; a moving contact arm 24 which is rotatably pivoted by a pivot 25; a cross-bar 26 which mechanically connects a plurality of the moving contact members and is to be coupled to a known handle (not shown in the figure).

FIG. 1 shows a tripped condition that the moving contact 23 is separated from the stationary contact (which is not shown in the figure ). In FIG. 1, link mechanisms for linking the moving contact mechanism and the trip lever 7, a handle (not shown in the figure) and the like are omitted.

In the circuit breaker with an overcurrent tripping device configured as above, the operation arm 18 always receives a rotation force of the spring 20 in a direction to separate the moving core 10 from the fixed core 4. Since the stopper part 18*a* of the operation arm 18 contacts the stopper parts 15*e* of the holder 15, a gap between the fixed core 4 and the moving core 10 is maintained within a predetermined dimension tolerance. Under this condition, when an overload current such as a shortcircuited current, which is above a predetermined value, flows on the conductor 2, the fixed core 10 generates a magnetic attraction force, and thereby the moving core 10 is attracted to the fixed core 4 against the force of the spring 20. As a result, the operation arm 18 starts to rotate, and the pushing part 18*b* of the operation arm 18 pushes and rotates the trip lever 7. When the trip lever 7 is rotated, the circuit breaker turns to the tripping state. On the other hand, when the value of the overload current is relatively small, the bimetal 5 warps responding to the temperature rise of the conductor 2. And thereby, the trip lever 7 is rotated by the warped bimetal 5, after passing a predetermined time from the start of the temperature rise.

Furthermore, as shown in FIG. 2, the arms 20*a* of the spring 20 are respectively engaged with the inner face 16*a* of the U-letter shaped section of the presser plate 16 (that is, the distance between both arms 20*a* is kept smaller than the length L1), and the distance is not expanded to the width L2 of the operation arm 18. Accordingly, the operation arm 18 moves smoothly without any interference of the spring 20.

In the above-mentioned embodiment, the double torsion spring is used as the spring 20. However, a tension spring or a compression spring, which is provided between the holder pre-assembly unit and the operation arm pre-assembly unit, can be used for supplying the rotation force of the operation arm pre-assembly unit.

Furthermore, when the torsion spring is used as the spring 20, hooking holes are provided on the conductor 2 or the presser plate 16, and the arms 20*a* of the spring 20 can be engaged with the hooking holes. Thereby, the distance between both arms 20*a* can be regulated so as not to interfere the motion of the operation arm pre-assembly unit.

In the circuit breaker configured above and shown in FIGS. 1, 2 and 3, the fixed core 4 is previously fixed on the holder 15, and the moving core 10 is also previously fixed on the operation arm 18. The operation handle 18 is borne on the holder 15 via the shaft 19, before assembling the overcurrent tripping device. Therefore, the gap between the moving core 10 and the fixed core 4 can be adjusted in the predetermined dimension tolerance during the previous assemblage of the operation arm 18 on the holder 15. As a result, the adjustable screw for adjusting the gap between the fixed core 4 and the moving core 10, which has been necessary in the conventional circuit breaker, is no longer needed in the circuit breaker in accordance with the present invention. Furthermore, the overcurrent tripping device becomes smaller, and thereby, the total size of the circuit breaker also becomes smaller. Still more, since the main parts of the overcurrent tripping device is united into one unit comprising the conductor 2, the fixed core 4, the bimetal 5, the holder 15, the moving core 10, and the operation arm 18 prior to the overall assemblage, the assembly work for the circuit breaker becomes easy.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A circuit breaker with an overcurrent tripping device comprising:

a conductor, an end thereof being connected to a moving contact mechanism and another end being connected to a terminal member;

a fixed core provided in the vicinity of said conductor for generating a magnetic attraction force responding to a current value flowing on said conductor;

a holder having a bimetal which contacts said conductor and warps responding to a current flowing on said conductor for driving a trip member; and an operation arm rotatably borne on said holder and having a moving core on an end thereof which opposes a face of said fixed core, an action part provided on another end of said arm for driving said trip member when said operation arm is rotated in a predetermined direction, and a stopper part for contacting said holder for maintaining a predetermined gap between said fixed core and said moving core when said stopper part contacts said holder.

2. A circuit breaker with overcurrent tripping device comprising:

a conductor, an end thereof being connected to a moving contact mechanism and another end being connected to a terminal member;

a fixed core provided in the vicinity of said conductor for generating a magnetic attraction force responding to a current value flowing on said conductor;

a holder having a bimetal which contacts said conductor and warps responding to a current flowing on said conductor for driving a trip member;

an operation arm rotatably borne on said holder and having a moving core on an end thereof which opposes a face of said fixed core, an action part provided on another end of said operation arm for driving said trip member when said operation arm is rotated in a predetermined direction, and a stopper part for contacting said holder for maintaining a predetermined gap between said fixed core and said moving core when said stopper part contacts said holder; and a spring provided between said holder and said operation arm for supplying a rotation force to said operation arm in a direction to separate said moving core from said fixed core.

3. A circuit breaker with overcurrent tripping device in accordance with claim 1 or 2, further comprising:

a holder pre-assembly unit which is constituted by said holder, said fixed core, said conductor, said bimetal and a presser plate which has a substantially U-letter shaped section, assembled in the mentioned order and which is fixed to said pressure plate.

4. A circuit breaker with overcurrent tripping device in accordance with claim 1 or 2, further comprising:

an operation pre-assembly unit which is constituted by said operation arm which is rotatably borne on said holder pre-assembly unit and said moving core which is fixed on the operation arm.

* * * * *